United States Patent [19]

Studer

[11] 4,168,553

[45] Sep. 25, 1979

[54] TOILET ODOR ELIMINATING DEVICE

[76] Inventor: Carl W. Studer, 1307 Mill St., Midland, Mich. 48640

[21] Appl. No.: 905,141

[22] Filed: May 12, 1978

[51] Int. Cl.[2] ..... E03D 9/05

[52] U.S. Cl. ..... 4/348; 4/213

[58] Field of Search ..... 4/348, 213, 217, 214, 4/216, 209 R

[56] References Cited

U.S. PATENT DOCUMENTS

| | | | |
|---|---|---|---|
| 2,172,506 | 9/1939 | Gerger | 4/217 |
| 3,469,267 | 9/1969 | Kuklok | 4/213 |
| 3,501,784 | 3/1970 | Maisch | 4/217 |

*Primary Examiner*—Lenard A. Footland

*Attorney, Agent, or Firm*—Daniel Jay Tick

[57] ABSTRACT

A plate is dimensioned to fit atop the rear flange of a toilet bowl and has a pair of bores formed therethrough in correspondence with those of the bowl so that it is affixable to the bowl beneath the toilet seat. A plurality of rectangular tubular channels are formed on the plate extending from its front edge to its back edge. A main tubular channel is formed on the plate extending along the back edge and has spaced opposite open ends. All the rectangular channels open into the main channel. Hosing couples the open ends of the main tubular channel of the plate to piping, which has a blower incorporated therein, extending from the area of the rear of the bowl to an exhaust outlet.

3 Claims, 6 Drawing Figures

TOILET ODOR ELIMINATING DEVICE

BACKGROUND OF THE INVENTION

The present invention relates to a toilet odor eliminating device. More particularly, the invention relates to a toilet odor eliminating device for a toilet having a toilet bowl with a rear flange part having a pair of spaced parallel bores formed therethrough for accommodating the bolts of a toilet seat.

Toilet odor eliminating devices are disclosed in U.S. Pat. Nos. 3,469,267; 3,585,651; 3,600,724; 3,733,619; 3,887,949 and 3,916,459.

Objects of the invention are to provide a toilet odor eliminating device of simple structure, which is inexpensive in manufacture, installed with facility and convenience on any type of toilet bowl, and functions efficiently, effectively and reliably to eliminate odors in the area of the bowl.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
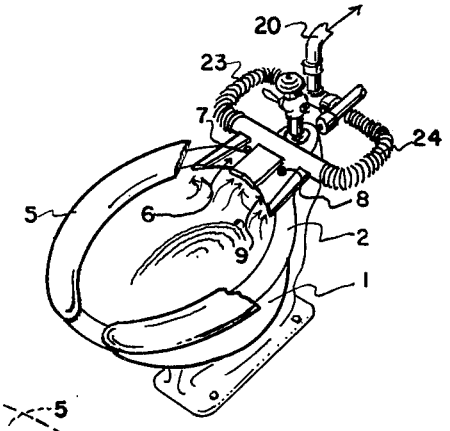
FIG. 1 is a perspective view of an embodiment of the toilet odor eliminating device of the invention installed on a toilet bowl.
Figure 2:
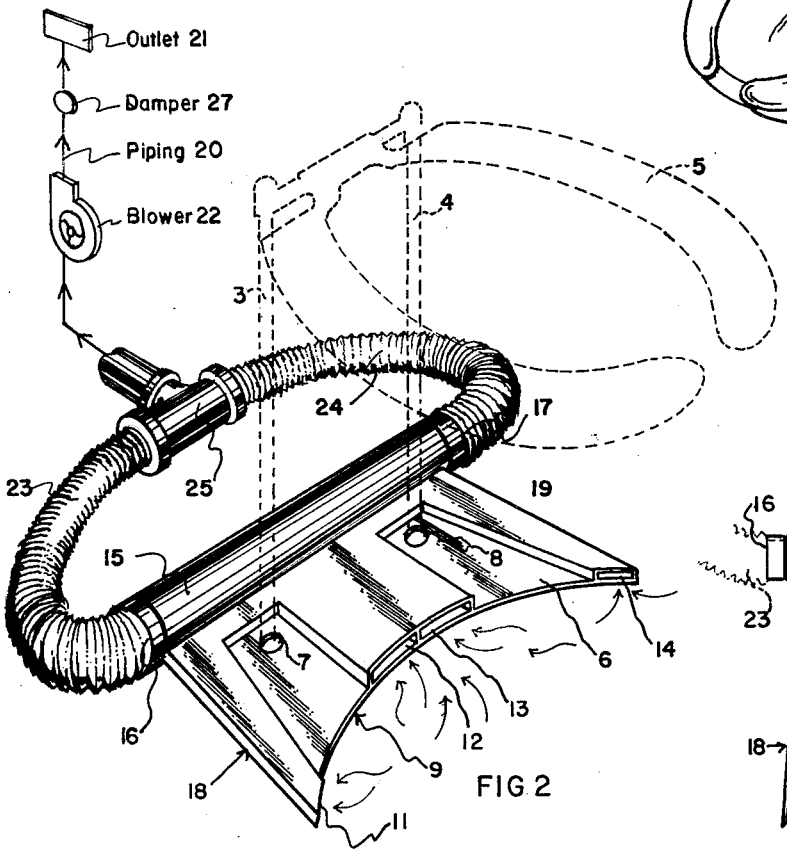
FIG. 2 is a perspective view, on an enlarged scale, of the embodiment of FIG. 1.

The toilet odor eliminating device of the invention is for a toilet having a toilet bowl 1 with a rear flange part 2, as shown in FIG. 1, having a pair of spaced parallel bores formed therethrough (not shown in the FIGS.) for accommodating the bolts 3 and 4 (FIG. 2) of a toilet seat 5 (FIGS. 1 and 2).

Figure 3:
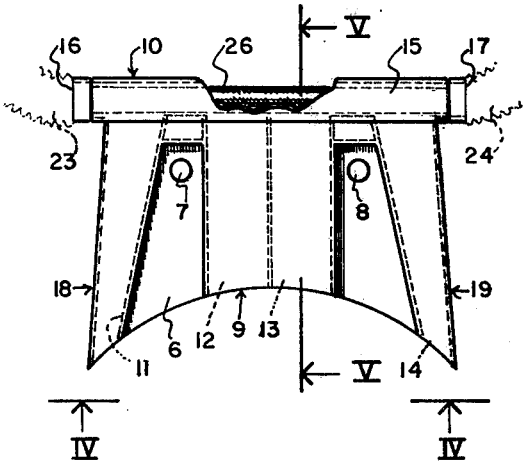
FIG. 3 is a top plan view, on an enlarged scale, partly cutaway, of the plate of the embodiment of FIG. 2.

The toilet odor eliminating device of the invention comprises a plate 6 dimensioned to fit atop the rear flange part 2 of the toilet bowl 1. The plate 6 has a pair of bores 7 and 8, respectively therethrough in correspondence with the bores of the bowl 1 (FIGS. 1 to 3). The plate 6 is affixable to the bowl 1 beneath the toilet seat 5 via the bores 7 and 8.

The plate 6 has a rounded front edge 9 (FIGS. 1 to 3) at the inner rim of the bowl 1, as shown in FIG. 1, and a back edge 10 (FIGS. 3 to 5) at the back of the rear flange part 2 of said bowl, as shown in FIG. 1.

The plate 6 has a plurality of rectangular cross-sectioned tubular channels 11, 12, 13 and 14 (FIGS. 2 to 4) formed thereon and extending from the front edge 9 to the back edge 10. The plate 6 also has a main tubular channel 15 formed thereon, as shown in FIGS. 2 to 5, and extending along the back edge 10. The main tubular channel 15 has spaced opposite open base ends 16 and 17, respectively (FIGS. 2 and 3). All of the channels 11, 12, 13 and 14 open into the main channel 15 and extend at substantially right angles therefrom.

Figure 4:
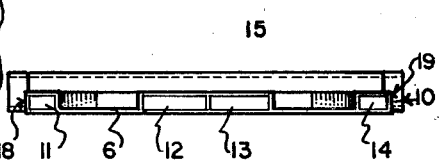
FIG. 4 is a view, taken along the lines IV—IV, of FIG. 3.

The plate 6 has a pair of spaced side edges 18 and 19, respectively, as shown in FIGS. 2 to 4. The channels 12 and 13 are next-adjacent each other at the center of the plate 6, equidistantly spaced from the side edges 18 and 19. The channels 11 and 14 are side channels, extending along the side edges 18 and 19, respectively, and spaced from the center channels 12 and 13, as shown in FIGS. 2 to 4.

Piping 20 (FIGS. 1 and 2) extends from the area of the rear of the toilet bowl 1 to an exhaust outlet 21 (FIG. 2).

A blower 22 (FIG. 2) is provided in the piping 20 for drawing air from the area of the bowl 1 to the exhaust outlet 21.

Hosing 23 and 24 couples the open ends 16 and 17, respectively, of the main tubular channel 15 of the plate 6 to the piping 20 via a tee joint 25, as shown in FIG. 2.

Figure 6:
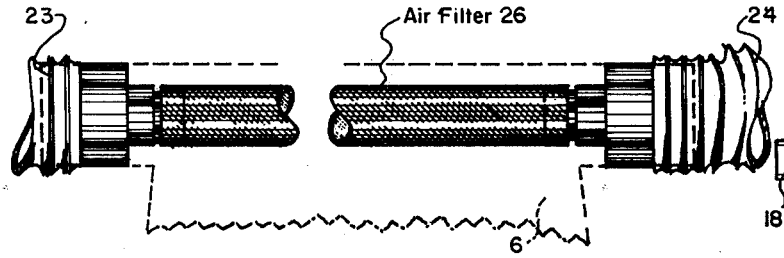
FIG. 6 is a view, on an enlarged scale, of an embodiment of the air filter of the embodiment of FIG. 1.
Figure 5:
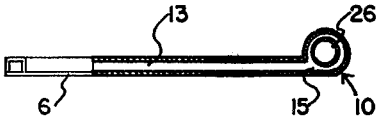
FIG. 5 is a cross-sectional view, taken along the lines V—V, of FIG. 3.

A cylindrical air filter 26 is substantially coaxially positioned in the main tubular channel 15, as shown in FIGS. 3, 5 and 6, for filtering solid particles out of air drawn to the exhaust outlet 21.

A damper 27 (FIG. 1) is interposed in the piping 20.

While the invention has been described by means of a specific example and in a specific embodiment, I do not wish to be limited thereto, for obvious modifications will occur to those skilled in the art without departing from the spirit and scope of the invention.

I claim:

1. A toilet odor eliminating device for a toilet having a toilet bowl with a rear flange part having a pair of spaced parallel bores formed therethrough for accommodating the bolts of a toilet seat, said toilet odor eliminating device comprising a plate dimensioned to fit atop the rear flange of a toilet bowl with a pair of bores formed therethrough in correspondence with those of said bowl whereby said plate is affixable to said bowl beneath the toilet seat, said plate having a rounded front edge at the inner rim of the bowl and a back edge at the back of the rear flange part, said plate having a plurality of rectangular tubular channels formed thereon extending from the front edge to the back edge and a main tubular channel formed thereon extending along said back edge and having spaced opposite open base ends, all of said channels opening into said main channel;

piping extending from the area of the rear of the toilet bowl to an exhaust outlet;

blower means in said piping for drawing air to the exhaust outlet;

hosing coupling the open ends of the main tubular channel of said plate to said piping; and a cylindrical air filter substantially coaxially positioned in the main tubular channel for filtering solid particles out of air drawn to the exhaust outlet.

2. A toilet odor eliminating device as claimed in claim 1, further comprising a damper interposed in said piping between said blower means and the exhaust outlet.

3. A toilet odor eliminating device for a toilet having a toilet bowl with a rear flange part having a pair of spaced parallel bores formed therethrough for accommodating the bolts of a toilet seat, said toilet odor eliminating device comprising a plate dimensioned to fit atop the rear flange of a toilet bowl with a pair of bores formed therethrough in correspondence with those of said bowl whereby said plate is affixable to said bowl beneath the toilet seat, said plate having a pair of spaced side edges, a rounded front edge at the inner rim of the bowl and a back edge at the back of the rear flange part, said plate having a plurality of rectangular tubular channels formed thereon extending from the front edge to the back edge and a main tubular channel formed thereon extending along said back edge and having spaced opposite open base ends, all of said channels opening into said main channel, said plurality of channels comprising a pair of next-adjacent center channels equidistantly spaced from said side edges and a pair of side channels each spaced from said center channels and extending along a corresponding one of said side edges;

piping extending from the area of the rear of the toilet bowl to an exhaust outlet;

blower means in said piping for drawing air to the exhaust outlet; and hosing coupling the open ends of the main tubular channel of said plate to said piping.

* * * * *